United States Patent [19]

Hamilton et al.

[11] 4,356,744

[45] Nov. 2, 1982

[54] SHOULDER PAD FORMER

[75] Inventors: C. Ray Hamilton; William O. Mitchell; Gordon H. Ellington, all of Vidalia, Ga.

[73] Assignee: Oxford Industries, Inc., Vidalia, Ga.

[21] Appl. No.: 160,853

[22] Filed: Jun. 19, 1980

[51] Int. Cl.[3] ..... B26D 1/38

[52] U.S. Cl. ..... 83/24; 83/27; 83/29; 83/89; 83/98; 83/155.1; 83/409.1; 83/926 R

[58] Field of Search ..... 2/268; 83/24, 27, 29, 83/98, 99, 84, 86, 89, 925 CC, 926 R, 155.1, 423, 409–409.2, 412, 414, 415, 466.1

[56] References Cited

U.S. PATENT DOCUMENTS

| | | | |
|---|---|---|---|
| 1,495,590 | 5/1924 | Hogelucht | 83/414 X |
| 1,758,587 | 5/1930 | Smith | 83/409.1 |
| 1,921,633 | 8/1933 | Nelson | 83/310 X |
| 2,289,015 | 7/1942 | Jackson | 83/409 X |
| 3,858,473 | 1/1975 | Bystron | 83/401 |
| 4,004,477 | 1/1977 | Mitchell et al. | 83/23 |

*Primary Examiner*—James M. Meister
*Attorney, Agent, or Firm*—Jones, Thomas & Askew

[57] ABSTRACT

Dome-shaped shoulder pad discs are placed in face-to-face overlying relationship and loaded in segmented carriers of a surface conveyor system. Each carrier moves its shoulder pad discs to a first station where the material is cut between the segments of the carrier and formed into a leading stack of shoulder pads, a following stack of shoulder pads, and an intermediate stack of waste material. The carrier is moved to a second station where the intermediate stack of waste material is pushed downwardly between the segments of the carrier and ejected. The leading segment of the carrier is moved to a third station where the leading stack of shoulder pads is picked from the leading segment of the carrier and moved to a stacker, and then the following segment of the carrier is moved to the third station where its stack of shoulder pads is picked from the following segment of the carrier and moved to the stacker. The stacker forms the shoulder pads in a vertical stack.

9 Claims, 7 Drawing Figures

240
242
244
245
246
248
249
250
251
252
254
255
266
268
269
270
271
272
274
275
276
277
278
279
280
282
284
285
286
287
288
289
290
291
292
294
295
296
298
300
301
302
304
305
306
308
309
310
311
312
314
315
316
318
319
320
322
324
325
326
328
329
340
342
344
345
346
162
169
174
176
178
180
104
188
190
204
222
232
236
238

SHOULDER PAD FORMER

BACKGROUND OF THE INVENTION

The invention disclosed herein relates to a method and apparatus for forming materials such as shoulder pads for garments, wherein multiple plies of the material are arranged in stacks, and the stacks are moved in sequence along a processing path where they are cut in the form of garment shoulder pads and the like.

Shoulder pads for garments, such as for suit jackets, usually comprise multiple layers of non-woven material that are laminated together. The shoulder pads usually are formed with wider layers of material at the bottom surface of the shoulder pad and narrower layers placed at the top surface so that the shoulder pad structure, if laid flat, is convex or curved to create a natural looking formation when inserted in the garment. Additionally, shoulder pads usually are formed with a relatively thin rounded portion that is to rest near the collar of the garment, and with a thicker relatively straight edge positioned adjacent the sleeve of the garment.

In the past, shoulder pads have been formed by dye cutting or "clicking" convex disc-shaped laminated layers of shoulder pad material with two approximately parallel cuts across the disc. The dome-shaped discs are made by placing layers of shoulder pad material together in overlying stacked relationship, with smaller diameter layers being placed atop larger diameter layers, and by needle-punching through the layers with barbed needles so as to mingle the fibers of adjacent layers together and thus laminate the layers. The relatively thin rounded arcuate edges of the shoulder pad cut from the dome-shaped discs of material form the portion of the shoulder pad that was to be positioned adjacent the collar of the garment and the relatively straight thicker cut portion formed the portion of the shoulder pad that was to be positioned adjacent the sleeve of the garment. The center portion formed by the two cuts through the disk of shoulder pad material was waste and discarded.

The cutting procedure usually was performed by placing pairs of the dome-shaped shoulder pad discs in face-to-face relationship, and placing a stack of discs in a conventional die cutting machine. This procedure is slow in that it requires the operator to match the discs of material together, place the discs in the cutting area, actuate the machine to make the die cut, and then remove and stack the cut pieces while discarding the waste.

SUMMARY OF THE INVENTION

Briefly described, the present invention comprises a method and apparatus for forming garment shoulder pads and the like wherein dome-shaped discs of shoulder pad material are matched in face-to-face relationship, the matched discs placed in carriers which are equally spaced on a conveyor, and the stacks of shoulder pad material moved by the carriers through a series of processing stations where the stacked discs of shoulder pad material are dye cut into leading and following stacks of shoulder pads with an intermediate stack of waste material. The waste material is ejected from between the leading and following stacks of shoulder pads, and the leading and following stacks of shoulder pads are sequentially formed in a vertical stack of shoulder pads.

Thus, it is an object of this invention to provide a method and apparatus for expediently and accurately forming garment shoulder pads and the like.

It is another object of this invention to provide an automated system for forming garment shoulder pads and the like which does not require the operator of the equipment to remove and stack the cut shoulder pads or to remove the waste material from between the cut stacks of shoulder pads.

Other objects, features and advantages of the present invention will become apparent upon reading the following specification, when taking in conjunction with the accompanying drawings.

DETAILED DESCRIPTION

Figure 1A:
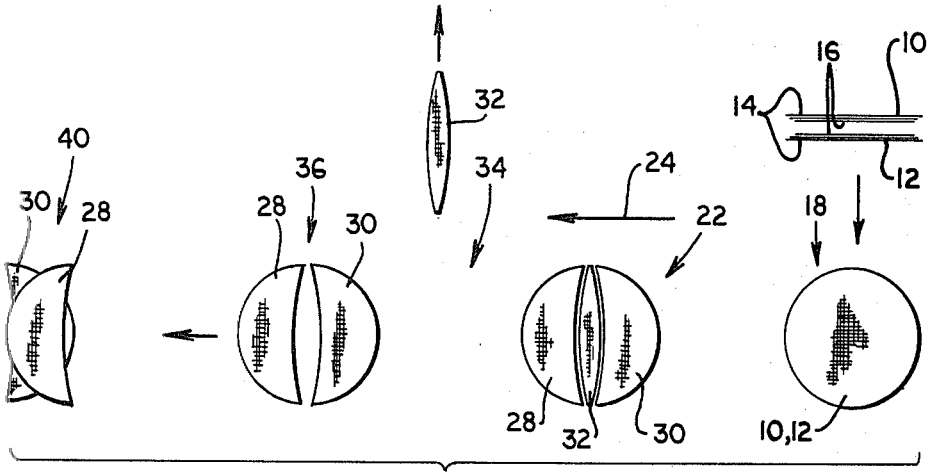
FIGS. 1A, 1B and 1C are schematic illustrations of the method of forming the shoulder pads, with FIG. 1A illustrating the stacked shoulder pad discs and the method of cutting the discs and stacking the cut shoulder pads, with FIG. 1B illustrating a plan view of the carriers for the shoulder pad discs, and with FIG. 1C illustrating a side view of the conveyor system, carriers and shoulder pad material.
Figure 1B:
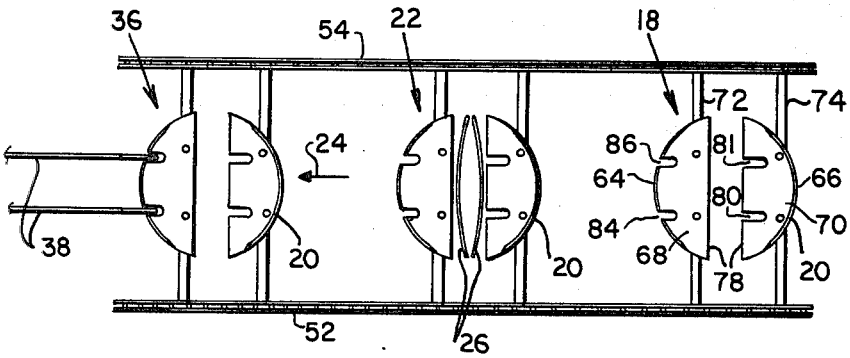
Figure 1C:
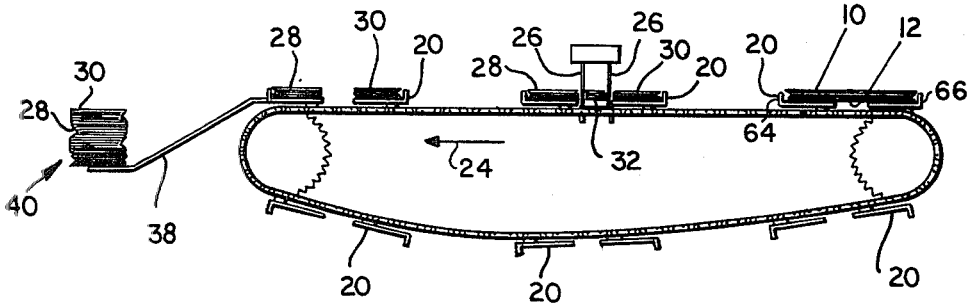

Referring now in more detail to the drawings, in which like numerals indicate like parts through the several views, FIG. 1A illustrates in schematic form the process of forming the shoulder pads, wherein at least one pair of shoulder pad discs 10, 12 are placed in overlying stacked relationship for processing. Each shoulder pad disc is fabricated from a plurality of layers of disc shaped shoulder pad material, with the bottom surface 14 of the laminated layers being of larger diameter than the top layers 16, and with the discs matched with their convex surfaces in face-to-face relationship. Each stack of shoulder pad discs are then placed in the first processing station 18 on a segmented carrier 20, the carrier 20 is moved to a second processing station 22 in the direction as indicated by arrow 24, and the stacked shoulder pad discs are cut with the blades 26 of a dye cutter to form the stacked discs into a leading stack 28 of shoulder pads, a following stack 30 of shoulder pads and an intermediate stack 32 of waste material. The carrier 20 is then indexed to a third processing station 34 where the intermediate stacked layer of waste material 32 is ejected from between the leading and following stacked shoulder pads 28 and 30. When the carrier 20 reaches the fourth processing station 36, the leading and following stacks of shoulder pads 28 and 30 are picked off the carriers 20 by pick fingers 38 and are placed in a vertical stack 40, with the leading stacks of shoulder pads 28 facing one direction and the following stacks facing the opposite direction.

Figure 2:
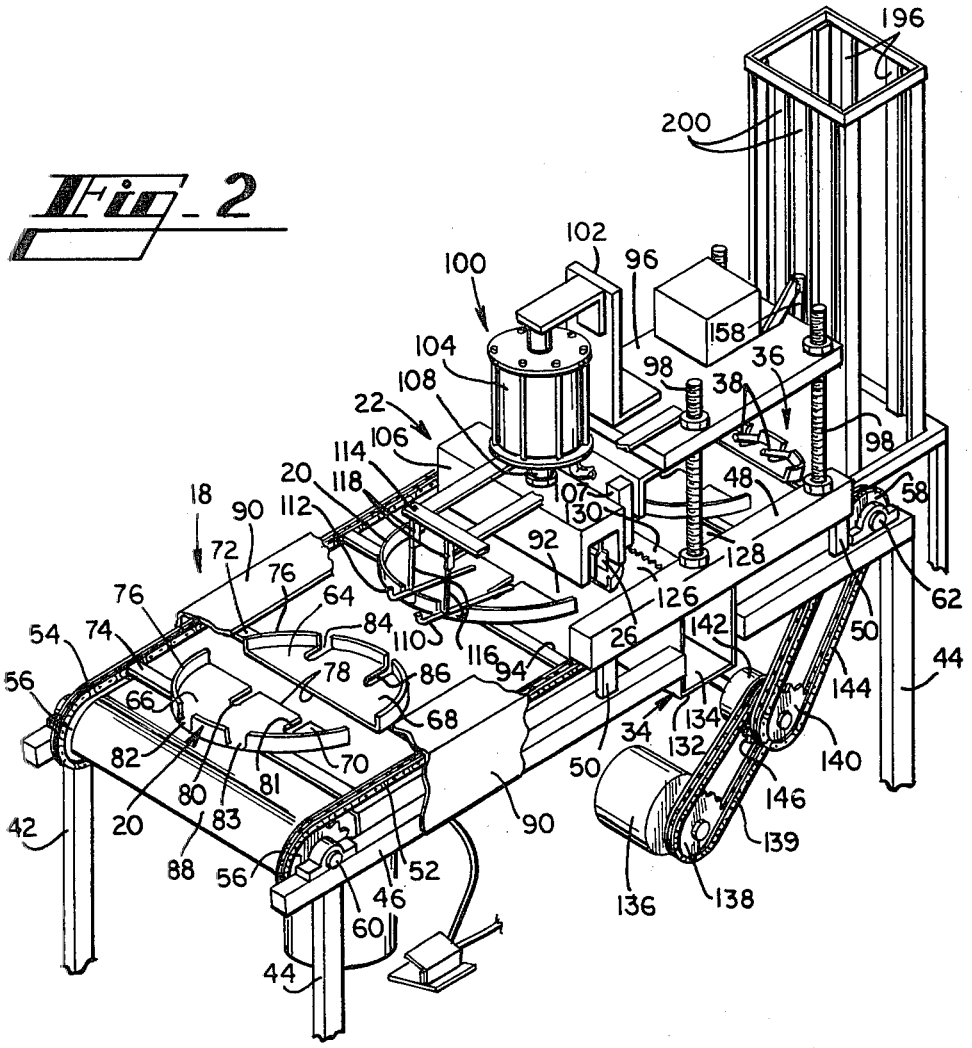
FIG. 2 is a perspective illustration of the shoulder pad forming and stacking equipment.
Figure 3:
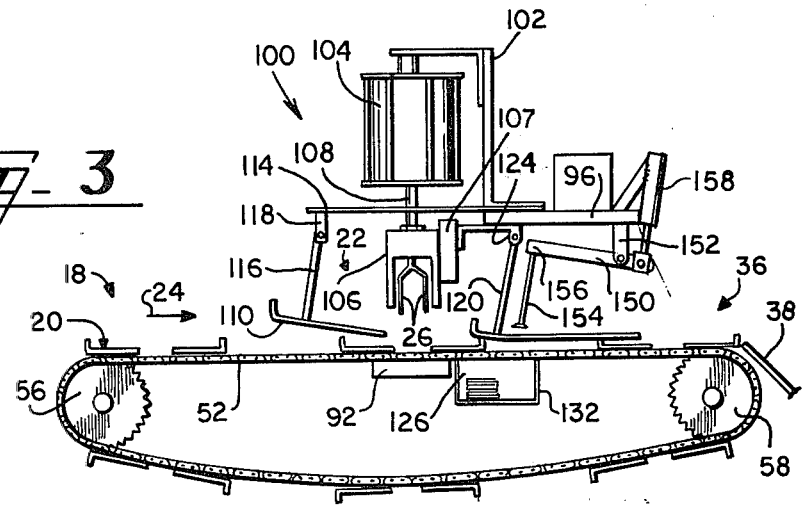
FIG. 3 is a side schematic illustration of the shoulder pad former.

As illustrated in FIG. 2, support framework 42 includes a plurality of upright legs 44 that support lower and upper rectangular frames 46 and 48. Upper frame 48 is mounted on lower frame as by legs 50.

A pair of continuous conveyor chains 52 and 54 extend about sprockets such as sprockets 56 at the entry of the framework and sprockets 58 at the exit. Sprockets 56 are joined together by a common axle 60, while sprockets 58 are joined together by a common axle 62. Thus, the sprockets and conveyor chains form a conveyor transport means.

The plurality of carriers 20 are each mounted on the conveyor transport means at equally spaced distances therealong. Each carrier 20 is segmented and includes leading carrier segment 64 and following carrier segment 66. The carrier segments 64 and 66 comprise relatively flat trays 68 and 70, respectively, with each tray mounted on a support strap 72, 74, respectively. Trays 68, 70 together form an approximate disc-shape with a peripheral flange 76 and facing rectilinear edges 78. Open ended slots 80 and 81 are formed in the leading edge of tray 70, extending from the edge 78 toward the flange 76, while notches 82 and 83 are formed in the flange 76, with each notch 82,83 being aligned with a slot 80,81. Open ended slots 84, 86 are formed in tray 68, extending through flange 76 at the leading edge of the tray toward following edge 78. The support straps 72 and 74 are mounted adjacent the trailing edge portion of each tray 68, 70, with the support strap 72 being located adjacent the rectilinear trailing edge 78 of tray 68, and with support strap 74 being located adjacent the trailing curved peripheral flange 76 of tray 70. Support straps 72 and 74 are mounted at their ends to conveyor chains 52, 54, and therefore function to move the trays 68, 70 of the segmented carriers 20 along a horizontal processing path.

Sheet metal 88 is mounted between the flights of conveyor chains 52, 54 and forms a work surface over which the carriers 20 move. Side fenders 90 extend about the conveyor chains as a safety feature for the worker that stands adjacent the equipment. The side fenders are illustrated as being broken away for clarity.

A cutting block 92 is supported by lower frame 46 adjacent the trailing edge 94 of the sheet metal work surface 88, and forms a continuation of the work surface. Cutter support platform 96 is mounted in spaced relationship above the plane of the work surface as formed by cutting block 92 and the sheet metal 88, and is supported in its position by upright threaded stanchions 98. Cutter assembly 100 is mounted to cutter support platform 96 and comprises support bracket 102, pneumatic ram 104, cutter support block 106, ram rod 108, and cutter blades 26. Pneumatic ram 104 functions to move cutter support block 106 and its blades 26 toward and away from cutting block 92. Guide blocks 107 are mounted on cutter support platform 96 and form guide surfaces against which cutter support block 106 slides, thus properly guiding cutting blades 26 toward and away from cutting block 92. The space between the trays 68 and 70 of each segmented carrier 20 is large enough to accommodate cutting blades 26, so that the cutting blades bear against cutting block 92 without engaging the trays 68 or 70.

A pair of presser bars 110, 112 are mounted from overhanging suspension assembly 114 at a position upstream of cutter assembly 100, between the loading station 18 and the cutting station 22. Presser bars 110 and 112 each include upwardly extending suspension bars 116 each mounted at their upper ends in clevises 118 of suspension assembly 114. The upstream ends of the presser bars 110, 112 are angled upwardly so as to ride over the discs 10, 12 of the shoulder pad material, and the trailing rectilinear ends of the presser bars are longer than the upstream ends causing the trailing ends to pivot downwardly and drag along the carriers 20 and the shoulder pad discs carried thereby as the carriers move into the cutting station 22. It will be noted that the presser bars 110, 112 are spaced apart a distance corresponding to the spacing of the slots and notches 80,81,82,83,84, and 86 in the trays 68, 70 of the carriers, so that the presser bars will engage primarily only the shoulder pad discs as they are moved through cutting station 22.

A second pair of presser bars 120, 122 are positioned beneath cutter support platform 96, and are pivotably mounted in clevises 124 that are mounted to the bottom surface of the cutter support platform 96. Presser bars 120, 122 are spaced downstream of cutting station 22 and are also spaced apart a distance corresponding to the slots and notches 80–86 of the carriers 20 so as to ride primarily only on the shoulder pad discs.

A waste ejector slot 126 is formed at the downstream edge of cutting block 92, between the cutting block and the sheet metal work surface 128. A serrated blade 130 projects an overhanging relationship partially over the waste ejector slot, with the blade being approximately co-extensive with the work surface, and with the serrated cutting edge of the blade facing the oncoming carriers and shoulder pad discs. An ejector tray 132 is located beneath the blade 130 in the slot, and forms an ejector opening 134 facing the side of the equipment.

Drive motor 136 is mounted beneath support framework 42, and its drive sprocket 138 drives chain 139 and the sprocket 140 of clutch brake 142. The driven chain 144 extends from the other sprocket 146 of the clutch brake 142 and drives a sprocket of axle 62, thus providing the motive power to the conveyor transport means.

Waste knock out lever 150 is located beneath cutter support platform 96 and is mounted thereto by clevis 152. A plurality of punch rods 154 extend downwardly from a cross bar 156 of waste knock out lever 150 toward waste ejector slot 126. Waste knock out cylinder 158 is mounted to cutter support platform 96 and its cylinder rod is connected to the distal end of waste knock out lever 150, and functions to oscillate punch rods 154 down into and upwardly away from waste ejector slot 126. With this arrangement, when a cut stack of shoulder pad discs have been moved to the waste discharge station 34, the knock out lever 150 is oscillated by its cylinder 158 so that punch rods 150 push the stack of waste material downwardly out from between the leading and following stacks of shoulder pads on into the waste ejector slot 126. When the carrier resumes its motion, the serrated blade 130 cuts any fibers that might extend between the stack of waste material and the leading and/or following stacks of shoulder pads.

The pair of pick fingers 38 are mounted in a stationary position at the delivery end of the apparatus, and the upper distal ends of the pick fingers 38 are spaced apart and located so as to register with the open ended slots and notches 80–86 of the carriers 20 as the carriers begin to move from their horizontal path and about their arcuate path at the delivery end of the apparatus, so as to begin movement on their return flight of the conveyor transport means. It will be noted that the leading portions of the carrier segments 68,70 maintain their horizontal altitude momentarily was to project over the upper distal ends of the pick fingers 38 and then move in a downward arcuate path as the support straps 72 and 74 swing downwardly away from the upper ends of the pick fingers, enabling the upper portions of the pick fingers 38 to project through the slots 80–86 of the trays and pick the shoulder pads off the trays as the trays swing down to their return flight of the conveyor transport.

Figure 4:
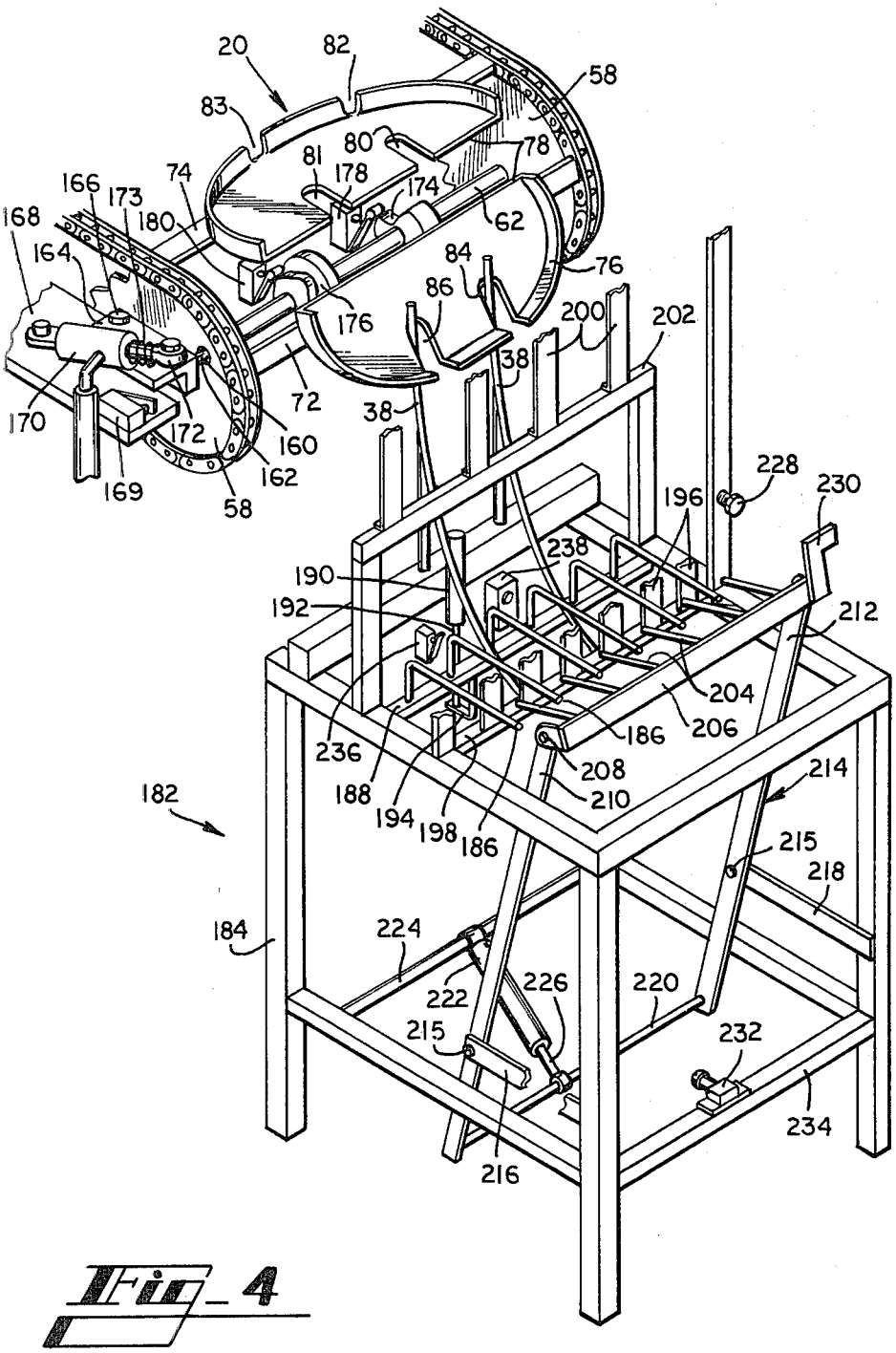
FIG. 4 is a perspective illustration of the stacker and the delivery end of the shoulder pad former.

As illustrated in FIG. 4, alignment opening 160 is formed in drive sprocket 58 on axle 62, and an alignment pin 162 is mounted so as to reciprocate toward and away from the path of alignment opening 160. Alignment pin 162 is mounted on pivotable support plate 164, and support plate 164 pivots about its pivot pin 166. Pivot pin 166 is mounted in stationary support plate 168. Pneumatic cylinder 170 is pivotally mounted on stationary support plate 168, and its cylinder rod 172 is connected to pivotable support plate 164 and functions to oscillate the pivotable support plate so that the alignment pin 162 is moved toward and away from the circular path of alignment opening 160. Coil compression spring 173 tends to distend cylinder rod 172 from cylinder 170, while the air pressure supplied to the cylinder 170 tends to retract cylinder rod 172. When alignment opening 160 is positioned as illustrated, alignment pin 162 can enter the alignment opening and sprocket 158 and the carriers 20 on the conveyor system will be located in a predetermined position, with a carrier accurately located beneath cutting blades 26, so that the cutting blades will move down between the segments of the carrier to cut against cutting block 92. Switch 169 is also mounted on stationary support plate 168 and is positioned so as to detect when alignment pin 162 is withdrawn from or positioned in alignment opening 160.

Cams 174 and 176 are rigidly mounted to axle 62 of driven sprocket 58 and rotate in unison with the sprocket. Switches 178 and 180 are positioned in the path of cams 174 and 176 and are opened and closed during the rotation of axle 62.

Stacker 182 is positioned at the delivery end of the cutting apparatus and comprises support frame 184 with movable support stacking rods 186. Stacking rods 186 are equally spaced apart from one another, and are approximately L-shaped with a horizontal portion that forms a receiving surface for the cut shoulder pads. The vertical portion of each stacking rod 186 is mounted to vertically movable cross bar 188. Cross bar cylinder 190 is mounted to framework 182, and its rod 192 is connected by L-shaped bracket 194 to cross bar 188, so that cylinder 190 is faced in a downward direction. Upon retracting its cylinder rod 192, cylinder 190 causes stacking rods 186 to be raised in a vertical direction.

Vertically extending wall straps 196 are supported on horizontal support bar 198 which is mounted in framework 184. Wall straps 196 extend vertically and are parallel with respect to one another. Similar vertically extending wall straps 200 are mounted from horizontal support bar 202 of framework 184, and together with wall straps 196 form a cage which supports vertically stacked shoulder pads. It will be noted that horizontal support bar 202 is elevated with respect to the framework 184 so that pick fingers 38 extend beneath horizontal support bar 202 a distance sufficient to permit the shoulder pads to slide down the inclined pick fingers, beneath horizontal support bar 202, until the shoulder pads engage wall straps 196 and stacking rods 186.

A plurality of parallel retaining bars 204 are each mounted at one end to pivotable support bar 206. Pivotable support bar 206 is mounted at each of its ends on pivot pins 208, and the pivot pins 208 are mounted at the upper ends of parallel side bars 210 and 212. Parallel side bars 210 and 212 together with pivot support bar 206 form a swinging frame 214 which is mounted by means of pivot pins 215 on stationary support legs 216 and 218 of frame 184. Lower stretcher rod 220 extends between the lower ends of parallel side bars 210 and 212, and swinging frame cylinder 222 is connected to stationary stretcher 224, and its cylinder rod 226 is connected to lower stretcher rod 220. Thus, the reciprocation of cylinder rod 226 causes swinging frame 214 to oscillate about its pivot pins 215, causing retaining bars 204 to swing back and forth between wall straps 196 of the stacker cage to oscillate retaining bars 204 back and forth, so as to enter between wall straps 196 of the stacker cage. Abutment screw 228 is threaded into one of the straps 196, and abutment plate is mounted to pivot support bar 206 of retaining bars 204. When the retaining bars 204 enter between the straps 196 of the stacker cage, abutment plate 230 engages abutment screw 228, causing pivot support bar 206 to pivot at the upper ends of parallel side bars 210, 212, causing the retaining bars to sweep in an upward arc within the stacker cage, from a level below the position of the raised stacking rods 186 to a position above the stacking rods 186, and when the retaining bars 204 are retracted from the stacking cage, they are permitted to move under the influence of gravity in a downward arc as they withdraw from the stacking cage.

Control switch 232 is mounted on stationary stretcher 234 in the path of movement of the lower stretcher rod 220, so as to be actuated when the retaining bars 204 have been projected in the stacking cage. Also, control switch 236 is located adjacent the up position of cylinder rod 192 of stacking rods 186, so as to be actuated when the stacking rods 186 are in their up position. Photoelectric cell 238 is located so as to view between the lower ends of the pick fingers 38, to detect the presence of a stack of shoulder pads that have moved down the pick fingers 238 to the lower portion of the stacker cage where they are ready to be moved up by the stacking rods to the bottom of the stack of shoulder pads.

CONTROL SYSTEM

Figure 5:
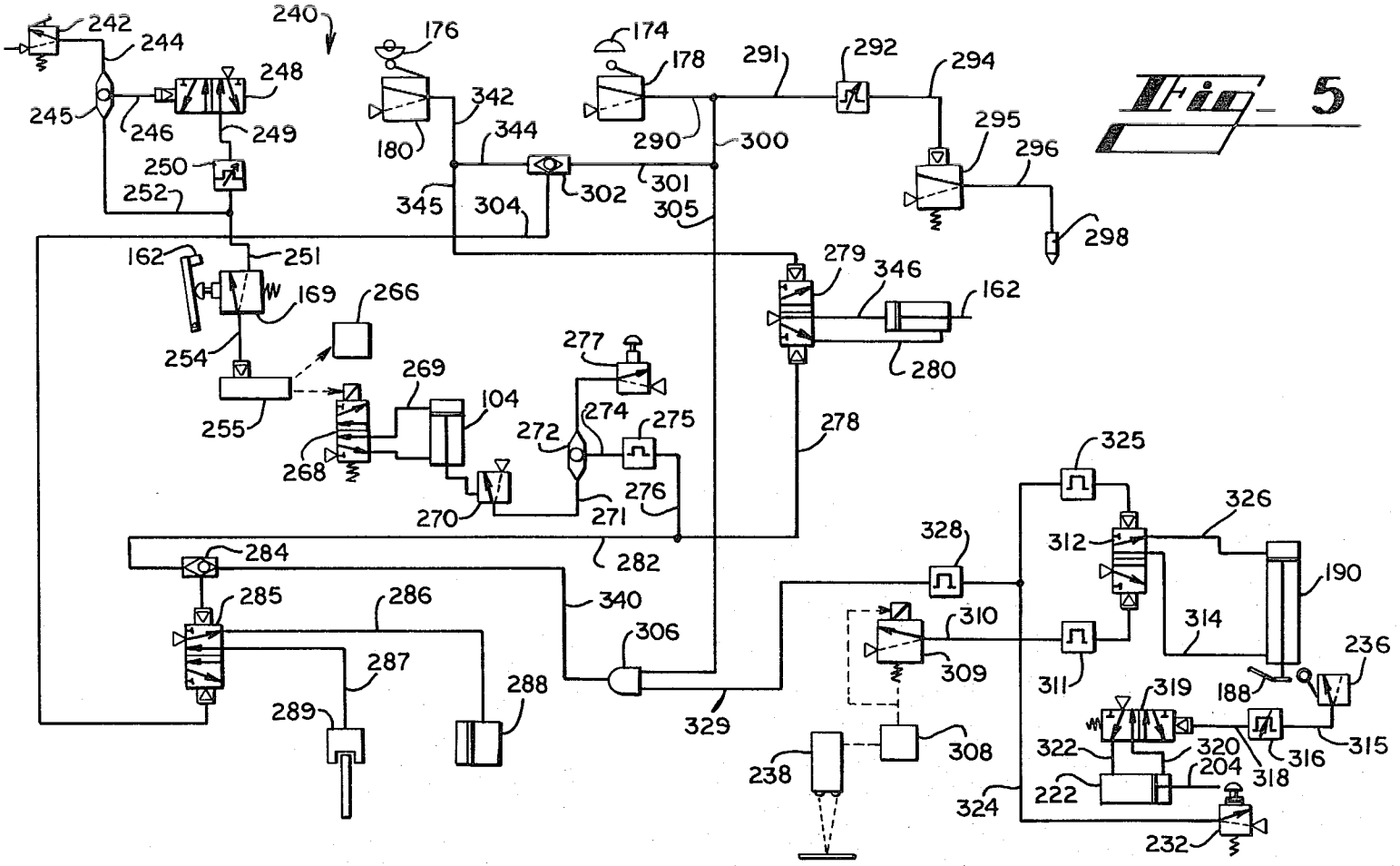
FIG. 5 is a schematic diagram of the pneumatic control system of the invention.

As illustrated in FIG. 5, pneumatic control system 240 includes foot switch 242 which is spring actuated to its open position and connected to a source of air pressure. The conduit 244 is connected through shuttle 245 to conduit 246 and spring actuated pilot valve 248. When pilot valve 248 is shifted against the bias of its spring, the source of air pressure communicates through conduit 249 to normally open adjustable pulse valve 250 which provides a pulse of air through conduit 251 for a predetermined short period of time. In the meantime, the pulse of air to conduit 251 also communicates through conduit 252 to the other side of shuttle 245, shifting the shuttle and maintaining the pressure on pilot valve 248, even if the operator takes her foot off actuator switch 242. Thus, a holding circuit is formed through pilot valve 248.

In the meantime, if the conveyor has moved a carrier 20 to the proper position beneath cutting blades 26, positioning pin 162 (FIG. 4) will be located in the alignment opening 160 and switch 169 will permit a flow of air from conduit 251 to conduit 254 and to electric switch 255. Switch 255 sends current to a count circuit 266 which counts the number of chops made by the cutting blade 26, and current to solenoid pilot valve 268, to move the pilot valve 268 against the bias of its spring. While the pilot valve is shifted against the bias of its spring, air under pressure is communicated through conduit 269 to the top of pneumatic ram 104, which moves the cutting blades 26 down into cutting engagement with the stack of shoulder pad discs on a carrier 20. The adjustable pulse valve 250 times out after enough time has lapsed to make a cut through the shoulder pad discs, and the signal is lost to pilot valve 268, whereupon the spring biases the pilot valve back to its return position and the upper portion of the ram 104 is vented while pressure is applied to the lower end of the ram, thus lifting the cutting blades.

As the cutting blades move toward their up rest position, they close valve 270. When valve 270 is closed, air is supplied through the valve to conduit 271 to shuttle 272. Shuttle 272 communicates air through conduit 274 to normally open adjustable pulse valve 275 which permits the flow of air to pass therethrough to conduit 276 for a limited time duration. Conduit 276 connects with conduit 278 and one side of double acting pilot valve 279. When pilot valve 279 is shifted by the flow of air from conduit 278, air under pressure communicates through pilot valve 279 and through conduit 280 to withdraw alignment pin 162 from its alignment opening 160. In the meantime, air from conduit 276 also communicates with conduit 282, through shuttle 284 to one end of double acting pilot valve 285. When pilot valve 285 is shifted because of the air from conduit 282, air is supplied through conduit 286 to clutch 288 while air is vented from brake 289. When clutch 288 is engaged and alignment pin 162 is withdrawn, movement of the conveyor commences.

While the system has been activated by the upward movement of the cutting blades of pneumatic ram 104, the system can be activated by manual valve 277, with valve 277 supplying air pressure to the other side of shuttle 272.

As the conveyor runs, cam 174 on axle 62 (FIG. 4) engages valve 178 when a carrier 20 is located over waste ejector slot 126. When valve 178 is closed, air is supplied through valve 178 to conduit 290, conduit 291, through normally open adjustable pulse valve 292, conduit 294 to air valve 295. When the air valve 295 is closed against the bias of its spring by the pulse of air from conduit 294, air moves through the valve 295 through conduit 296 to nozzle 298. Nozzle 298 is located in the vicinity of waste ejector slot 126 and is directed downwardly into and along the slot so as to direct a flow of air against the intermediate stack of waste material 32 that has been cut from the stack of shoulder pad discs. This urges the intermediate stack of waste material downwardly into and out of the waste ejector slot 126.

In the meantime, the air pressure from conduit 290 also communicates with conduit 300, conduit 301, shuttle 302, conduit 304, to the lower end of double acting pilot valve 285. Air from conduit 304 shifts the pilot valve 285, causing air to be supplied to brake 289 through its conduit 287, while the air to clutch 288 is vented to the atmosphere. Thus, the conveyor is stopped. In the meantime, air from conduit 300 moves through conduit 305 to and gate 306. The previous movement of the conveyor caused the leading stack of shoulder pads 28 to be dropped from the conveyor to the stacker, and photocell 238 detects the presence of the dropped stack of shoulder pads. Photocell 238 sends a signal through photo relay 308 to solenoid valve 309, causing valve 309 to shift and send air through conduit 310, through normally open adjustable pulse valve 311 to double acting pilot valve 312. Pilot valve 312 is shifted and sends air pressure through conduit 314 to the lower end of stack lift cylinder 190, causing the cylinder to move in an upward direction and lift the cut shoulder pads to the bottom of the vertically arranged stack. When the stacker 182 reaches the top of its movement, it engages valve 236, whereupon air pressure flows through the valve 236 through conduit 315, through normally open adjustable pulse valve 316, through conduit 318, to pilot valve 319, causing the pilot valve to shift against the bias of its spring. Air then moves through pilot valve 319 through conduit 320 to the front of cylinder 222, causing the retaining bars 204 to withdraw from the bottom of the stack of shoulder pads. When the adjustable pulse valve 316 times out, pilot valve 319 shifts with its spring so as to supply air pressure through conduit 322, thus causing the retaining bars to move back to their supporting position. When retaining bars 204 move back to their supporting position, valve 232 is engaged and sends air through conduit 324, through normally open adjustable pulse valve 325 to the other side of pilot valve 312 whereupon air is supplied through conduit 326 to the rear of stack lift cylinder 190, causing the stacker to move back to its home position. When adjustable pulse valve 325 times out, the system remains in its current position until the photo scanner 238 detects another shoulder pad whereupon the stacking procedure is repeated. In the meantime, air from conduit 324 passes through normally open adjustable pulse valve 328, through conduit 329 to and gate 306. Now that both conduits 305 and 329 have charged and gate 306, air flows through and gate 306, through conduit 340 to shuttle 284 whereupon brake 289 is released and clutch 288 is engaged, to resume the conveyor movement.

When a carrier 20 reaches a cut position beneath the blades 26, cam 176 engages its valve 180, and air pressure communicates through conduit 342, conduit 344, shuttle 302, conduit 304 to pilot valve 285, whereupon brake 289 is applied and clutch 288 is opened. In the meantime, air from conduit 342 communicates through conduit 345 to double acting pilot valve 279, causing the pilot valve to shift and whereupon air flows through pilot valve 279 and through conduit 346, causing alignment pin 162 to engage alignment opening 160 and locate the carrier 20 directly beneath the cutting blades. Now the system is ready to be actuated again by the operator, by the operator depressing foot switch 242.

While this invention has been described as a garment shoulder pad cutting and stacking system, it should be apparent that other items can be formed and stacked by the process. Moreover, the invention has been described in specific detail with particular reference to a preferred embodiment thereof, but it will be understood that variations and modifications can be effected within the spirit and scope of the invention as described hereinbefore and as defined in the appended claims.

I claim:

1. A method of forming garment shoulder pads and the like comprising the steps of:

placing plies of shoulder pad material in overlying stacked relationship in the leading and following segments of a carrier, moving the carrier along a processing path through a series of processing stations with the leading segment of the carrier preceding the following segment, when the carrier reaches a first processing station, cutting through the stack of shoulder pad material between the segments of the carrier with a cut that forms the stack in a stack of leading shoulder pads, a stack of following shoulder pads and a stack of waste material between the leading and following stacks of shoulder pads, when the carrier reaches a second processing station, removing the stack of waste material from between the leading and following stacks of shoulder pads, when the leading segment of the carrier reaches a third processing station, removing the leading stack of shoulder pads from the carrier, when the following segment of the carrier reaches the third processing station, removing the following stack of shoulder pads from the carrier, and placing the leading and following stacks of pads in sequence as they are removed from the carrier in a vertical stack.

2. The method of claim 1 and wherein the step of placing plies of shoulder pad material in overlying stacked relationship in the carrier comprises placing the plies in face-to-face relationship.

3. The method of claim 1 and wherein the step of removing the stack of waste material from between the leading and following stacks of shoulder pads comprises pushing the stack of waste material downwardly between the leading and following stacks of shoulder pads and between the leading and following segments of the carrier.

4. The method of claim 1 and wherein the steps of removing the leading and following stacks of shoulder pads from the carrier comprise moving the leading segment of the carrier in an arcuate path with slots of the leading segment of the carrier passing about pick fingers and picking the leading stack with the pick fingers out of the leading segment of the carrier, and moving the following segment of the carrier in an arcuate path with slots of the following segment of the carrier passing about the pick fingers and picking the following stack with the pick fingers out of the following segments of the carrier.

5. The method of claim 1 and wherein the step of removing the stack of waste material from between the leading and following stacks of shoulder pads comprises pushing the stack of waste material downwardly between the leading and following stacks of shoulder pads and propelling the stack of waste material laterally away from the processing path.

6. Apparatus for forming garment shoulder pads and the like comprising a continuous conveyor transport means, plurality of carriers equally spaced along said conveyor transport means, means for driving said conveyor transport means to move said carriers in sequence through an upper horizontal processing path and a lower return path whereby said carriers support and move stacked plies of garment shoulder pad material along the processing path, each of said carriers comprising a leading carrier segment and a following carrier segment spaced rearwardly from said leading carrier segment along the direction of movement of the carriers, cutting means positioned along the processing path comprising means for cutting the stacked plies of garment shoulder pad material into three stacks including a leading stack of shoulder pads, a following stack of shoulder pads and an intermediate stack of waste material positioned between said leading and following stacks of shoulder pads, means for moving said cutting means down into engagement with the stacks of shoulder pad material at a position between the leading and following carrier segments of each carrier to cut the stacks of shoulder pad material, a waste ejector for moving the stack of waste material out from between the leading stack and following stack of shoulder pad material, and means for sequentially picking the leading stack and following stack of shoulder pads from each carrier.

7. The apparatus of claim 6 and wherein said continuous conveyor transport means comprises a pair of endless conveyor chains extending in parallel, side-by-side relationship, and wherein said leading carrier segment and following carrier segment of each carrier includes a tray, a support strap connected to the trailing edge portion of each of said trays and connected at opposite end portions to said conveyor chains, and wherein each tray defines open ended slots extending through its leading edge toward its support strap, and wherein said means for sequentially picking the leading stack and following stack of shoulder pads from each carrier comprises stationary pick fingers located in the processing path with the slots of each tray movable about the pick fingers.

8. Apparatus for forming garment shoulder pads and the like comprising a continuous conveyor transport means, a plurality of carriers equally spaced along said conveyor transport means, drive means for driving said conveyor transport means to move each of said carrier means through a series of work stations along a processing path, each of said carriers comprising a leading segment and a following segment positioned behind the leading segment along the direction of movement of the carriers, cutting means positioned along the processing path, means for moving said cutting means into engagement with the stacks of shoulder pad material at a position between the leading and following carrier segments of each carrier when each carrier is adjacent said cutting means, said cutting means being structured to cut the stacks of shoulder pad material on each carrier into a leading stack of shoulder pads, a following stack of shoulder pads and an intermediate stack of waste material between the leading and following stacks of shoulder pads, waste material ejector means positioned adjacent said cutting means comprising means movable into engagement with the intermediate stack of waste material of each carrier for removing the intermediate stack of waste material out from between the leading stack and following stack of shoulder pads on each carrier, and pick means positioned adjacent said waste material ejector means for picking the leading stack and following stack of shoulder pads in sequence from said carriers.

9. The apparatus of claim 8 and wherein the leading segment and the following segment of each of said carriers each include at least one open ended slot extending from the leading edge rearwardly of the segment, and wherein said pick means comprises a pick rod in the processing path for projecting through the slots of the carrier to pick the shoulder pads off the carrier.

* * * * *